US009434059B2

(12) United States Patent
Hecht et al.

(10) Patent No.: US 9,434,059 B2
(45) Date of Patent: Sep. 6, 2016

(54) HAMMER MECHANISM

(75) Inventors: Joachim Hecht, Magstadt (DE); Martin Kraus, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 633 days.

(21) Appl. No.: 13/989,224

(22) PCT Filed: Oct. 14, 2011

(86) PCT No.: PCT/EP2011/067974

§ 371 (c)(1),
(2), (4) Date: Aug. 12, 2013

(87) PCT Pub. No.: WO2012/072328

PCT Pub. Date: Jun. 7, 2012

(65) Prior Publication Data

US 2013/0319708 A1 Dec. 5, 2013

(30) Foreign Application Priority Data

Nov. 29, 2010 (DE) ..... 10 2010 062 106
Apr. 19, 2011 (DE) ..... 10 2011 007 691

(51) Int. Cl.

| | |
|---|---|
| ***B25D 16/00*** | (2006.01) |
| ***B25B 21/02*** | (2006.01) |
| ***B25D 11/00*** | (2006.01) |
| ***B25D 11/06*** | (2006.01) |
| ***B25F 5/00*** | (2006.01) |
| ***B25D 17/06*** | (2006.01) |

(52) U.S. Cl.

CPC ..... *B25D 16/00* (2013.01); *B25B 21/023* (2013.01); *B25D 11/005* (2013.01); *B25D 11/062* (2013.01); *B25D 17/06* (2013.01); *B25F 5/001* (2013.01); *B25D 2216/003* (2013.01); *B25D 2216/0023* (2013.01); *B25D 2217/0015* (2013.01); *B25D 2217/0019* (2013.01); *B25D 2250/131* (2013.01); *B25D 2250/301* (2013.01)

(58) Field of Classification Search

CPC ..... B25D 16/00; B25D 2216/0023; B25D 11/062
USPC ..... 173/47–48, 109
See application file for complete search history.

(56) References Cited

U.S. PATENT DOCUMENTS

RE33,733 E * 11/1991 Hendrikx ..... B25D 11/005 173/109

FOREIGN PATENT DOCUMENTS

| | | |
|---|---|---|
| DE | 36 11 890 | 10/1987 |
| EP | 1 834 737 | 9/2007 |

OTHER PUBLICATIONS

International Search Report for PCT/EP2011/067974, dated Dec. 16, 2011.

* cited by examiner

*Primary Examiner* — Michelle Lopez
(74) *Attorney, Agent, or Firm* — Norton Rose Fulbright US LLP

(57) ABSTRACT

A hammer mechanism is provided, which has at least one impact-generation unit which includes a strike element, a clamping chuck drive shaft mounting the strike element in movable manner in the strike direction in at least one operating state, and a coupling unit which is connected to the clamping chuck drive shaft in torsionally fixed manner and provided to drive the impact-generation unit.

20 Claims, 8 Drawing Sheets

HAMMER MECHANISM

BACKGROUND OF THE INVENTION

1. Field of the Invention

The present invention relates to a handheld machine tool having a hammer mechanism.

2. Description of the Related Art

Handheld machine tools which have an impact-generation unit, in which a hammer means is supported inside a hammer cylinder so as to be able to move are already known. The hammer cylinder, a clamping chuck and a wobble bearing of the impact-generation unit are driven by an intermediate shaft.

BRIEF SUMMARY OF THE INVENTION

A hammer mechanism is described, which has at least one impact-generation unit provided with a hammer means, a clamping chuck drive shaft mounting the hammer means in a manner that allows it to move in the strike direction in at least one operating state, and a coupling means, which is connected to the clamping chuck drive shaft in torsionally fixed manner and drives the impact-generation unit. An "impact-generation unit" in particular denotes a unit provided to translate a rotary motion into an, in particular, translatory strike motion of the hammer means which is suitable for drilling or impact drilling. In particular, the impact-generation unit is developed as an impact-generation unit considered useful by the expert, but preferably is implemented as a pneumatic impact-generation unit and/or, especially preferably, as an impact-generation unit having a rocker lever. A "rocker lever" in particular denotes a means that is mounted so as to allow movement about a pivot axis and which is provided to output power that was picked up in a first coupling area, to a second coupling area. A "hammer means" in particular denotes a means of the hammer mechanism that is meant to be accelerated by the impact-generation unit, in particular in translatory fashion, during its operation, and to output a pulse, picked up during the acceleration, in the direction of an inserted tool in the form of a strike pulse. The strike means preferably is supported by air pressure or, advantageously, by a rocker lever, such that it is able to be accelerated in the strike direction. Immediately prior to a strike, the strike means preferably is in a non-accelerated state. During a strike, the strike means preferably outputs a strike pulse in the direction of the inserted tool, in particular via a snap die. A "clamping chuck drive shaft" in particular denotes a shaft which transmits a rotary motion from a gearing, especially a planetary gearing, in the direction of a clamping chuck during a drilling and/or an impact drilling operation. Preferably, the shaft is at least partially developed as full shaft. The clamping chuck drive shaft preferably extends across at least 40 mm in the strike direction. In a drilling and/or in an impact drilling operation, the clamping chuck drive shaft and the clamping chuck have the same rotational speed, preferably always, i.e., no gear unit is provided on a drive train between the clamping chuck drive shaft and the clamping chuck. The term "clamping chuck" in particular denotes a device provided for the direct mounting of an inserted tool in at least torsionally fixed manner by a user, especially in a manner that is reversible without using a tool. A "strike direction" in particular denotes a direction that extends parallel to an axis of rotation of the clamping chuck and which runs from the strike means in the direction of the clamping chuck. The strike direction preferably is aligned parallel to an axis of rotation of the clamping chuck drive shaft. The term "mount so as to allow movement" specifically means that the clamping chuck drive shaft has a bearing surface which in at least one operating state transmits bearing forces to the strike means, in a direction perpendicular to the strike direction. A "coupling means" in particular denotes a means provided to transmit a motion from one component to another component at least by a keyed connection. The keyed connection preferably is designed to be reversible by the user in at least one operating state. In an especially preferred manner, the keyed connection is reversible for a switch between operating modes, i.e., advantageously between a screwing, drilling, cutting and/or an impact drilling operation. The coupling means in particular is developed as a coupling considered useful by the expert, but advantageously takes the form of a dog clutch and/or toothing. The coupling means advantageously includes a plurality of keyed connection elements and a region that connects the keyed connection elements. "In torsionally fixed manner" in particular means that the coupling means and the clamping chuck drive shaft are fixedly connected to each other in at least the circumferential direction, preferably in all directions, and, in particular, in all operating states. "Provided" in particular means specially configured and/or equipped. "Drive" in this context in particular describes that the coupling means transmits kinetic energy, especially rotational energy, to at least one region of the impact-generation unit. Preferably, the impact-generation unit uses this energy to drive the strike means. The development according to the present invention makes it possible to provide an especially compact and powerful hammer mechanism using constructively simple measures.

In addition, it is provided to develop the coupling means in one piece with the clamping chuck drive shaft, so that an inexpensive production is able to be realized. As an alternative or in addition, the coupling means could also be joined to the clamping chuck drive shaft in some other way that appears useful to the expert, but it is advantageously press-fitted, screw-fitted or joined in form-fitting manner in the circumferential direction and axially via a safety ring or a band. "In one piece" in particular means at least integrally, e.g., using a welding process, a bonding process, an injection-molding process or some other process considered expedient by the expert and/or is advantageously formed in one piece, for example by producing it from a casting and/or advantageously, from a single blank.

In another development, the coupling means dips into a coupling means of the impact-generation unit, at least when a strike mode is activated, which advantageously requires little design space. An "activation of a strike mode" in particular describes an adjustment process in which the operator in particular adjusts the hammer mechanism in such a way that the impact-generation unit drives the hammer means in a striking manner while operating. In the process, the operator preferably switches from a drilling and/or screwing mode into an impact drilling and/or cutting mode. "Dipping into a coupling means" in particular means that the coupling means is situated outside a recess of the impact-generation unit in one operating mode and is moved into the recess when the strike mode is activated. A "recess" in particular means a region delimited by the impact-generation unit which is enclosed by the coupling means over more than 180 degrees, advantageously more than 270 degrees, especially advantageously, over 360 degrees, on at least one plane which advantageously is aligned perpendicularly to the strike direction.

Furthermore, it is provided that the clamping chuck drive shaft penetrates the strike means at least partially, so that a clamping chuck drive shaft having an especially low mass and small space requirement is able to be realized. The phrase "penetrates at least partially" in particular means that the hammer means encloses the clamping chuck drive shaft over more than 270 degrees, advantageously over 360 degrees, on at least one plane that advantageously is oriented perpendicularly to the strike direction. Preferably, the hammer means is mounted on the clamping chuck drive shaft in form-fitting manner in a direction perpendicular to the axis of rotation of the clamping chuck drive shaft, i.e., supported in movable manner in the direction of the axis of rotation.

In addition, it is provided that the hammer mechanism includes at least one bearing, which mounts the clamping chuck drive shaft in axially displaceable manner and thereby provides a simple way of deactivating the hammer mechanism. A "bearing" in this context specifically describes a device which mounts the clamping chuck drive shaft especially in relation to a housing in a manner that allows movement about the axis of rotation and an axial displacement. The phrase "axial displacement" in particular means that the bearing mounts the clamping chuck drive shaft in a manner that allows it to move, especially relative to a housing, in a direction parallel to the strike direction. A connection of the coupling means of the clamping chuck drive shaft driving the impact-generation unit preferably is reversible by shifting the clamping chuck drive shaft in the axial direction.

It is furthermore provided that the hammer mechanism includes a planetary gearing which drives the clamping chuck drive shaft in at least one operating state, so that an advantageous translation is able to be achieved using little space. Moreover, a torque restriction and a plurality of gear stages are realizable by simple constructive measures. A "planetary gearing" in particular means a unit having at least one planetary wheel set. A planetary wheel set preferably includes a sun gear, a ring gear, a planetary wheel carrier and at least one planetary wheel which is guided along a circular path about the sun gear by the planetary wheel carrier. Preferably, the planetary gearing has at least two translation ratios, selectable by the operator, between an input and an output of the planetary gearing.

In one advantageous development of the present invention, the clamping chuck drive shaft has an additional coupling means, which is provided to produce an axially displaceable, torsionally fixed connection to the planetary gearing, so that a simple design is achievable. An "axially displaceable, torsionally fixed connection" in particular describes a connection provided to transmit a force in the circumferential direction and to allow movement of the clamping chuck drive shaft relative to the planetary gearing.

Furthermore, the hammer mechanism includes a torque-restriction device provided to restrict a torque that is maximally transmittable via the clamping chuck drive shaft, so that the operator is advantageously protected and the hand-held tool is able to be used in a comfortable and safe manner for screw-fitting operations. "Restrict" in this context in particular means that the torque-restriction device prevents an exceeding of the maximal torque adjustable by an operator, in particular. The torque-restriction device preferably releases a connection between a drive motor and the clamping chuck, which is torsionally fixed during operation. As an alternative or in addition, the torque-restriction device may act on an energy supply of the drive motor.

Furthermore, the hammer mechanism has a clamping chuck and a snap die provided with a coupling means for transmitting a rotary motion to the clamping chuck, thereby creating an especially compact hammer mechanism. The snap die advantageously transmits a rotary motion of the clamping chuck drive shaft to the clamping chuck. A "snap die" in particular means an element of the hammer mechanism that transmits the strike pulse from the hammer means in the direction of the inserted tool during a strike operation. The snap die preferably strikes the inserted tool directly in at least one operating state. The snap die preferably prevents dust from making its way through the clamping chuck into the hammer mechanism.

In addition, the impact-generation unit includes a spur gear transmission stage which translates a rotational speed of the clamping chuck drive shaft into a higher rotational speed for impact generation, and thereby makes it possible in a space-saving and uncomplicated manner to achieve an especially advantageous ratio between the rotational speed and the number of strikes of an inserted tool. A "spur-gear transmission stage" in particular denotes a system of especially two toothed wheel works engaging with one another, which are mounted so as to be rotatable about parallel axes. On a surface facing away from their axis, the toothed wheel works preferably have gear teeth. A "rotational speed for strike generation" in particular is a rotational speed of a drive means of the impact-generation unit considered useful by the expert, which drive means translates a rotary motion into a linear motion. The drive means of the impact-generation unit preferably is developed in the form of a wobble bearing or, especially preferably, as an eccentric element. "Translate" in this case means that there is a difference between the rotational speed of the clamping chuck drive shaft and the rotational speed for the impact generation. The rotational speed for an impact generation preferably is higher, advantageously at least twice as high as the rotational speed of the clamping chuck drive shaft. Especially preferably, a translation ratio between the rotational speed for impact generation and the rotational speed of the clamping chuck drive shaft is a non-integer ratio.

Moreover, the hammer mechanism includes an impact-generation deactivation unit equipped with a blocking element which acts on the snap die, parallel to at least one force of the clamping chuck drive shaft, at least in a drilling operation and especially in a screwing operation, so that an advantageous placement of an operating element of the impact-generation deactivation unit is possible using measures that are uncomplicated in terms of design. In particular, an annular operating element, which encloses the snap die or the clamping chuck drive shaft, is easily able to be realized. In addition, this development requires little space. An "impact-generation deactivation unit" in particular means a unit provided to allow an operator to switch off the impact-generation unit for a drilling and/or screwing operation. The impact-generation deactivation unit preferably prevents an especially automatic activation of the impact-generation unit when an inserted tool is pressed against a workpiece in a drilling and/or screwing mode. The pressure application in a cutting and/or impact drilling mode preferably causes an axial displacement of the clamping chuck drive shaft. The blocking element is advantageously provided to prevent an axial displacement of the clamping chuck drive shaft, the clamping chuck and/or advantageously the snap die in the drilling and/or screw-fitting mode. "Parallel to a force" in particular means that the clamping chuck drive shaft and the blocking element apply a force to the snap die at two different locations in at least one operating state. As an alternative or in addition, the clamping chuck drive shaft and the blocking element are able to exert a force on the clamping chuck at two different locations in at least one operating state. The forces preferably have a component that is oriented in the same direction, i.e., preferably parallel to the axis of rotation of the clamping chuck drive shaft, from the clamping chuck drive shaft in the direction of the clamping chuck. The blocking element preferably acts on the snap die directly, but especially preferably, at least via a clamping chuck bearing. Preferably, the clamping chuck drive shaft is acting directly on the snap die. The snap die preferably transmits a rotary motion from the clamping chuck drive shaft to the clamping chuck.

Moreover, a handheld tool is provided, which includes a hammer mechanism according to the present invention. A "handheld tool" in this context in particular describes a handheld tool that appears useful to the expert, but preferably a drilling machine, an impact drill, a screw driller, a boring tool and/or an impact drilling machine. The handheld tool preferably is developed as a battery-operated handheld tool, i.e., the handheld tool in particular includes a coupling means provided to supply a drive motor of the handheld tool with electrical energy from a handheld tool battery pack connected to the coupling means.

DETAILED DESCRIPTION OF THE INVENTION

Figure 1:
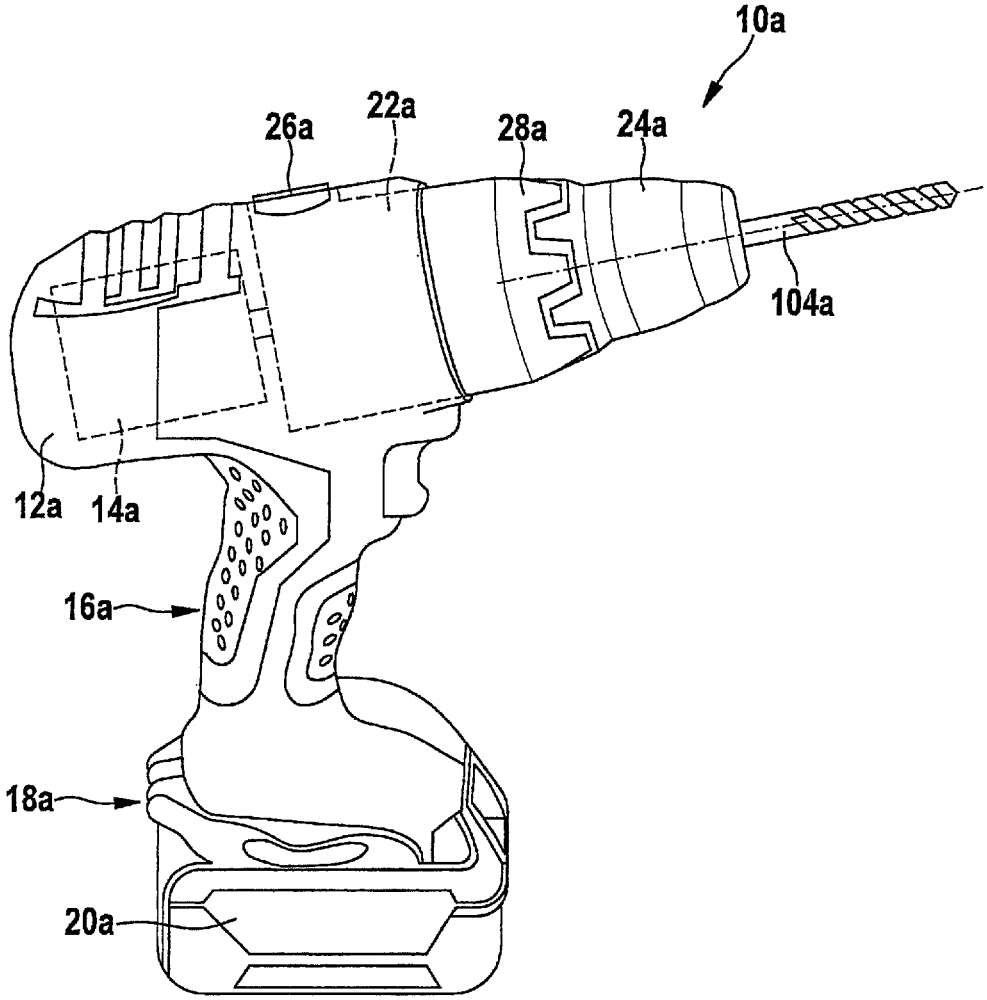
FIG. 1 shows A handheld tool having a hammer mechanism according to the present invention, in a perspective view.

FIG. 1 shows a handheld tool 10*a*, which is developed as impact drill screwer. Handheld tool 10*a* has a pistol-shaped housing 12*a*. A drive motor 14*a* of handheld tool 10*a* is situated inside housing 12*a*. Housing 12*a* has a handle region 16*a* and a battery coupling means 18*a*, which is disposed at an end of handle region 16*a* facing away from drive motor 14*a*. Battery coupling means 18*a* links a handheld tool battery 20*a*, which link is severable by an operator either electrically or mechanically. Handheld tool battery 20*a* has an operating voltage of 10.8 Volt, but could also have a different, especially higher, operating voltage. Furthermore, handheld tool 10*a* is provided with a hammer mechanism 22*a* according to the present invention, which includes a clamping chuck 24*a* disposed on the outside, and operating elements 26*a*, 28*a*.

Figure 2:
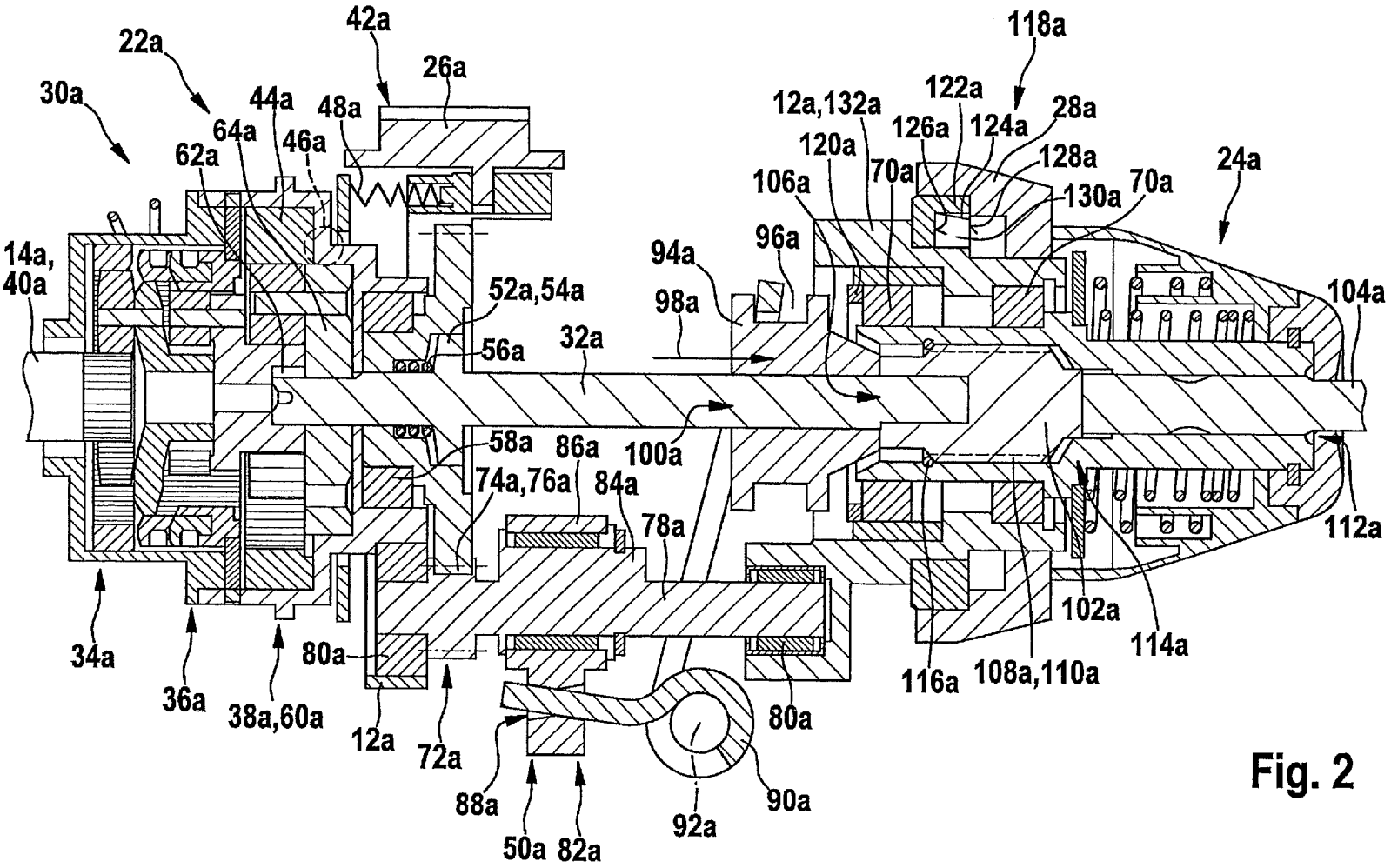
FIG. 2 shows a section of the hammer mechanism of FIG. 1.

FIG. 2 shows hammer mechanism 22*a* in a sectional view. Hammer mechanism 22*a* also includes a planetary gearing 30*a* and a clamping chuck drive shaft 32*a*. When in operation, planetary gearing 30*a* drives clamping chuck drive shaft 32*a* in rotary motions about an axis of rotation. Planetary gearing 30*a* has three planetary gear stages 34*a*, 36*a*, 38*a* for this purpose. An operator is able to adjust the transmission ratio of planetary gearing 30*a* between a rotor 40*a* of drive motor 14*a* and clamping chuck drive shaft 32*a* in at least two stages. As an alternative, a transmission ratio between drive motor 14*a* and clamping chuck drive shaft 32*a* could also be designed to be non-adjustable.

Hammer mechanism 22*a* is equipped with a torque restriction device 42*a*. While in operation, torque restriction device 42*a* fixates a ring gear 44*a* of planetary gearing 30*a*. Torque restriction device 42*a* has fixation balls 46*a* for this purpose, which engage with recesses of ring gear 44*a*. A spring 48*a* of torque restriction device 42*a* exerts a force on fixation balls 46*a*, in the direction of ring gear 44*a*. Using one of operating elements 26*a*, the operator is able to move an end of spring 48*a* facing fixation balls 46*a* in the direction of fixation balls 46*a*. Operating element 26*a* includes an eccentric element for this purpose. Thus, the force acting on fixation balls 46*a* is adjustable. If a particular maximum torque has been reached, fixation balls 46*a* are pushed out of the recesses and ring gear 44*a* runs freely, thereby interrupting a force transmission between rotor 40*a* and clamping chuck drive shaft 32*a*. Torque restriction device 42*a* thus serves the purpose of restricting a maximum torque transmittable via clamping chuck drive shaft 32*a*.

Figure 3:
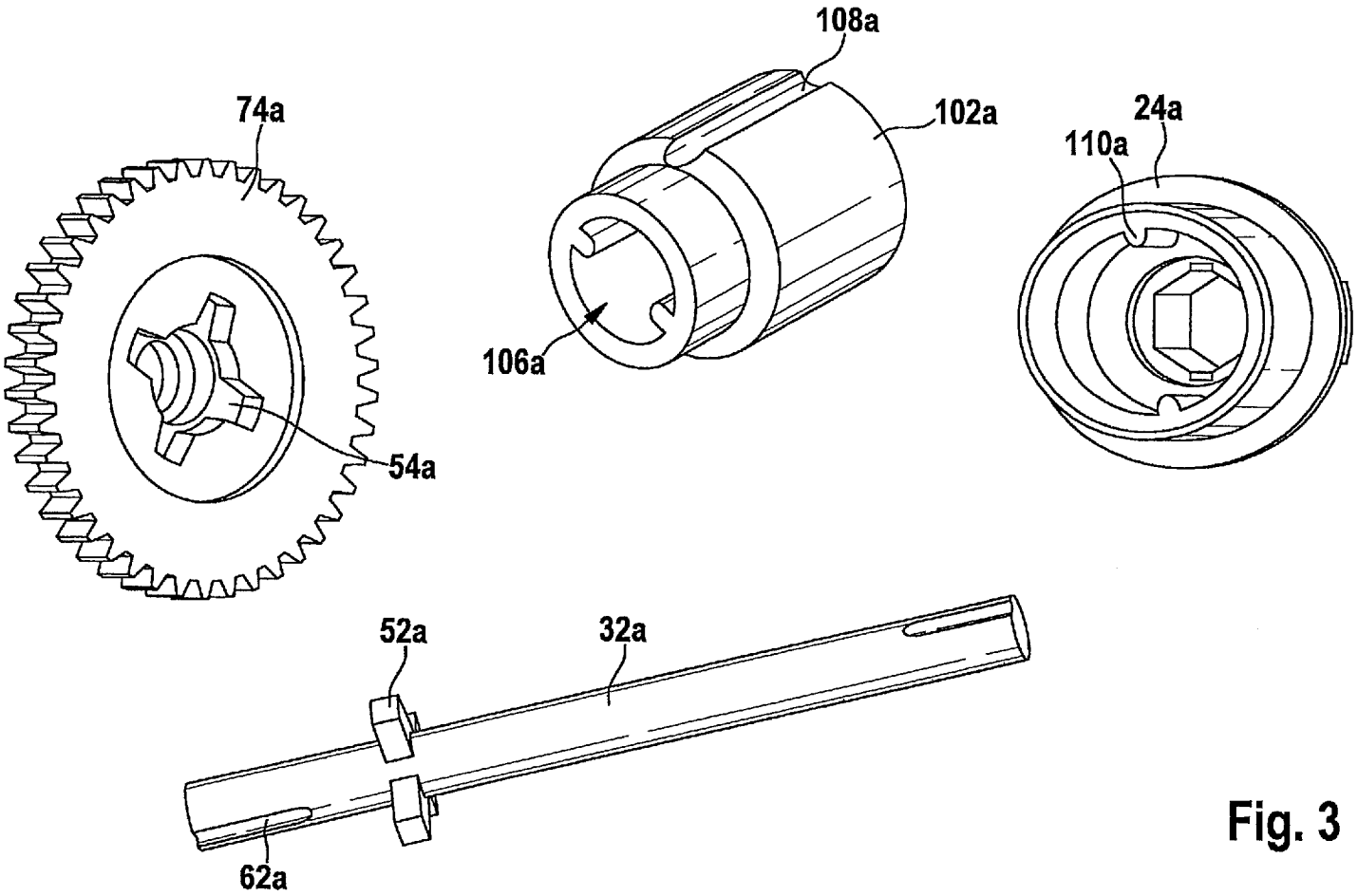
FIG. 3 shows a coupling means, a clamping chuck drive shaft, a snap die, and a portion of a clamping chuck of the hammer mechanism from FIG. 1, shown individually in a perspective view in each case.

Hammer mechanism 22*a* includes an impact-generation unit 50*a* and a first coupling means 52*a*. First coupling means 52*a* is connected to clamping chuck drive shaft 32*a* in torsionally fixed manner, first coupling means 52*a* and clamping chuck drive shaft 32*a* being formed in one piece, in particular. Impact-generation unit 50*a* is provided with a second coupling means 54*a* which is connected to first coupling means 52*a* in torsionally fixed manner in a drilling and/or impact drilling mode. As shown in FIG. 3 as well, first coupling means 52*a* are developed as premolded shapes and second coupling means 54*a* are developed as recesses. When the drilling mode is activated, first coupling means 52*a* dips into second coupling means 54*a*, i.e., to the full extent. As a result, the coupling between first coupling means 52*a* and second coupling means 54*a* is reversible by axial shifting of clamping chuck drive shaft 32*a* in the direction of clamping chuck 24*a*. A spring 56*a* of hammer mechanism 22*a* is situated between first coupling means 52*a* and second coupling means 54*a*. Spring 56*a* presses clamping chuck drive shaft 32*a* in the direction of clamping chuck 24*a*. When impact-generation unit 50*a* is deactivated, it opens the link between first coupling means 52*a* and second coupling means 54*a*.

Hammer mechanism 22*a* is provided with a first bearing 58*a*, which fixates second coupling means 54*a* relative to housing 12*a* in the axial direction and rotationally mounts it coaxially with clamping chuck drive shaft 32*a*. Furthermore, hammer mechanism 22*a* includes a second bearing 60*a*, which rotationally mounts clamping chuck drive shaft 32*a* on a side facing drive motor 14*a*, such that it is able to rotate about the axis of rotation. Second bearing 60*a* is developed in one piece with with one of the three planetary gear stages 38*a*. Clamping chuck drive shaft 32*a* is provided with a coupling means 62*a*, which connects it to a planet carrier 64*a* of this planetary gear stage 38*a* in axially displaceable and torsionally fixed manner. As a result, this planetary gear stage 38*a* serves the purpose of mounting clamping chuck drive shaft 32*a* in axially displaceable manner. On a side facing clamping chuck 24*a*, clamping chuck drive shaft 32*a* together with clamping chuck 24*a* is rotationally mounted with the aid of a clamping chuck bearing 70*a*. Clamping chuck bearing 70*a* has a rear bearing element which, axially fixated, is pressed onto clamping chuck 24*a*. In addition, clamping chuck bearing 70*a* has a front bearing element which supports clamping chuck 24*a* inside housing 12*a* in axially displaceable manner.

Impact-generation unit 50*a* includes a spur gear transmission stage 72*a*, which translates a rotational speed of clamping chuck drive shaft 32*a* into a higher rotational speed for impact generation. A first toothed wheel 74*a* of spur gear transmission stage 72*a* is integrally formed with second coupling means 54*a*. In an impact drilling operation, it is driven by clamping chuck drive shaft 32*a*. A second toothed wheel 76*a* of spur gear transmission stage 72*a* is integrally formed with a hammer mechanism shaft 78*a*. An axis of rotation of hammer mechanism shaft 78*a* is disposed next to the axis of rotation of clamping chuck drive shaft 32*a* in the radial direction. Impact-generation unit 50*a* includes two bearings 80*a*, which mount hammer mechanism shaft 78*a* in axially fixed and rotatable manner. Impact-generation unit 50*a* includes a drive means 82*a*, which translates a rotary motion of hammer mechanism shaft 78*a* into a linear motion. An eccentric element 84*a* of drive means 82*a* is integrally formed with hammer mechanism shaft 78*a*. Using a needle roller bearing, for example, an eccentric sleeve 86*a* of drive means 82*a* is mounted on eccentric element 84*a* in a manner that allows it to rotate relative thereto. Eccentric sleeve 86*a* has a recess 88*a*, which encloses a rocker lever 90*a* of impact-generation unit 50*a*.

Rocker lever 90*a* is pivotably mounted on a pivot axle 92*a* of impact-generation unit 50*a*, that is to say, it is able to pivot about an axis that runs perpendicularly to the axis of rotation of clamping chuck drive shaft 32*a*. An end of rocker lever 90*a* facing away from drive means 82*a* partially encloses a strike means 94*a* of hammer mechanism 22*a*. In so doing, the rocker lever engages with a recess 96*a* of strike means 94*a*. Recess 96*a* is developed in the form of a ring. In an impact drilling operation, rocker lever 90*a* exerts a force on strike means 94*a*, which accelerates it. Rocker lever 90*a* is moved in a sinusoidal pattern while in operation. Rocker lever 90*a* has a spring-elastic design. It has a spring constant between eccentric sleeve 86*a* and strike means 94*a* that is less than 100 N/mm and greater than 10 N/mm. In this particular exemplary embodiment, rocker lever 90*a* has a spring constant of approximately 30 N/mm.

Clamping chuck drive shaft 32*a* mounts strike means 94*a* so that it is movable in strike direction 98*a*. Strike means 94*a* delimits a recess 100*a* for this purpose. Clamping chuck drive shaft 32*a* penetrates strike means 94*a* through recess 100*a*. In so doing, strike means 94*a* encloses recess 100*a* to 360 degrees in a plane perpendicular to recess 100*a*. When operated, strike means 94*a* strikes a snap die 102*a* of hammer mechanism 22*a*. Snap die 102*a* is situated between an inserted tool 104*a* and strike means 94*a*. In the operative state, inserted tool 104*a* is fixed in place in clamping chuck 24*a*. Clamping chuck 24*a* mounts snap die 102*a* in a manner that allows it to move parallel to strike direction 98*a*. In an impact drilling operation, snap die 102*a* transmits strike pulses originating from strike means 94*a* to inserted tool 104*a*.

Clamping chuck drive shaft 32*a* is connected to snap die 102*a* in axially movable and torsionally fixed manner. Snap die 102*a* delimits a recess 106*a* for this purpose. When in an operative state, clamping chuck drive shaft 32*a* is partially situated inside recess 106*a* of snap die 102*a*. Clamping chuck drive shaft 32*a* is rotationally mounted with the aid of snap die 102*a*, clamping chuck 24*a* and clamping chuck bearing 70*a*. Clamping chuck 24*a* is rotationally driven by way of snap die 102*a*. Clamping chuck 24*a* and snap die 102*a* are each provided with a coupling means 108*a*, 110*a* for this purpose, the coupling means being provided to transmit the rotary motion to clamping chuck 24*a*. Coupling means 108*a* of snap die 102*a* is developed in the form of a groove, whose main extension runs parallel to strike direction 98*a*. Coupling means 108*a* extends along a radially outward-lying surface area of snap die 102*a*. Coupling means 110*a* of clamping chuck 24*a* is developed as a protrusion that fits the groove.

Clamping chuck 24*a* includes an inserted-tool coupling region 112*a*, in which inserted tool 104*a* is fixed in strike direction 98*a* during a drilling a screwing operation, or in which it is mounted in moveable manner in strike direction 98*a* during an impact-drilling operation. In addition, the clamping chuck includes a tapered region 114*a*, which delimits a movement range of snap die 102*a* in strike direction 98*a*. Furthermore, clamping chuck 24*a* is provided with a mounting ring 116*a*, which delimits a movement range of snap die 102*a* counter to strike direction 98*a*.

During an impact drilling operation, an operator presses inserted tool 104*a* against a workpiece (not shown further). The operator thereby shifts inserted tool 104*a*, snap die 102*a* and clamping chuck drive shaft 32*a* relative to housing 12*a*, in a direction counter to the strike direction 98*a*, i.e., in the direction of drive motor 14*a*. In so doing, the operator compresses spring 56*a* of hammer mechanism 22*a*. First coupling means 52*a* dips into second coupling means 54*a*, so that clamping chuck drive shaft 32*a* begins to drive impact-generation unit 50*a*. When the operator stops pressing inserted tool 104*a* against the workpiece, spring 56*a* shifts clamping chuck drive shaft 32*a*, snap die 102*a* and inserted tool 104*a* in strike direction 98*a*. This releases a torsionally fixed connection between first coupling means 52*a* and second coupling means 54*a*, and thereby switches impact-generation unit 50*a* off.

Hammer mechanism 22*a* has an impact-generation deactivation unit 118*a* which includes a blocking element 120*a*, a sliding block guide 122*a*, and operating element 28*a*. In a drilling or screwing mode, blocking element 120*a* exerts a force on snap die 102*a*, which acts on snap die 102 parallel to at least one force of clamping chuck drive shaft 32*a*. The force of blocking element 120*a* acts on snap die 102*a* via clamping chuck bearing 70*a*, clamping chuck 24*a*, and mounting ring 116*a*. The force of blocking element 120*a* prevents an axial displacement of snap die 102*a* and clamping chuck drive shaft 32*a* during a drilling and screwing mode, and thus prevents an activation of impact-generation unit 50*a*. The force of clamping chuck drive shaft 32*a* has a functionally parallel component which drives snap die 102*a* in rotating fashion during operation. In addition, the force has a functionally and directionally parallel component which is brought to bear on snap die 102*a* by spring 56*a* via clamping chuck drive shaft 32*a*.

Figure 4:
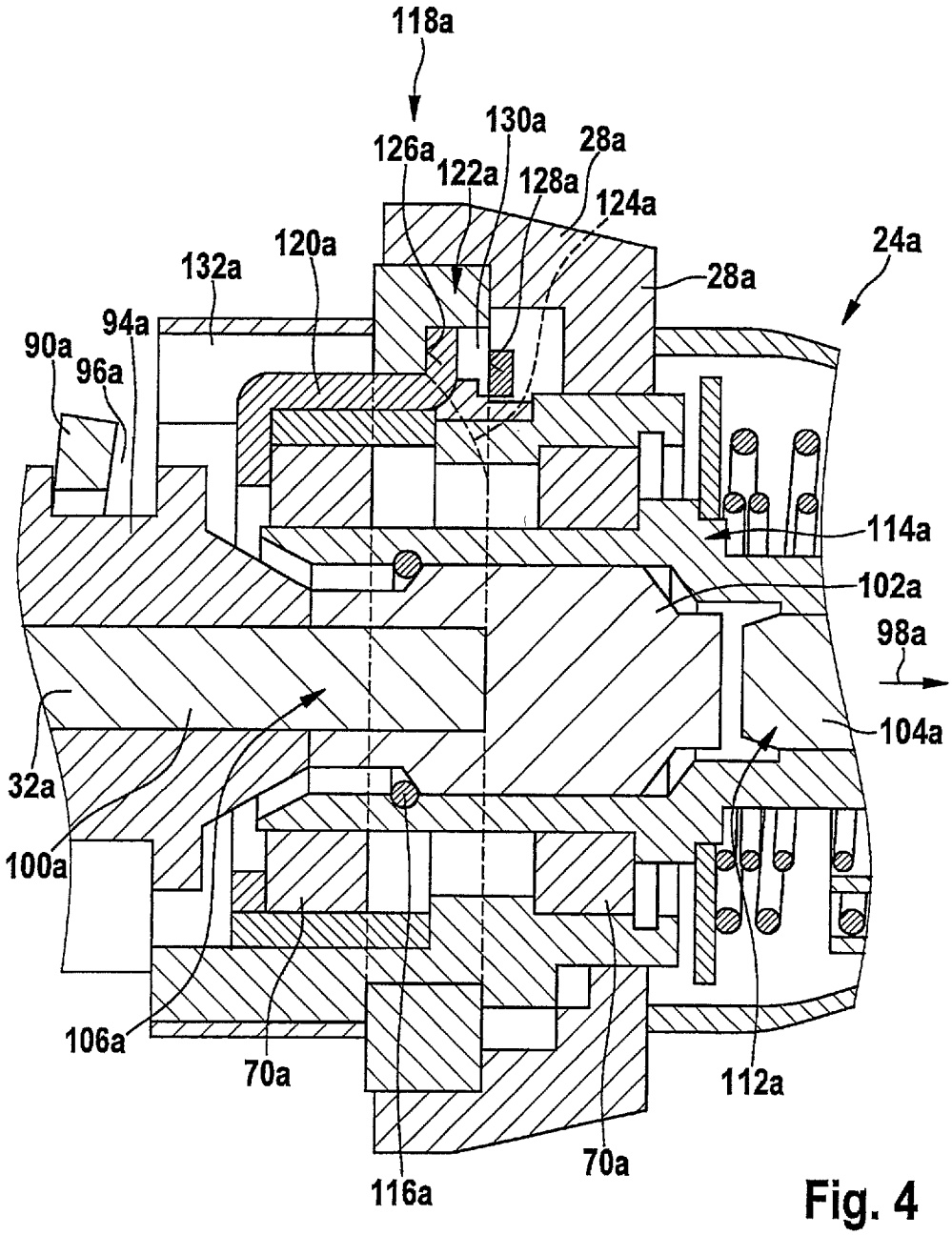
FIG. 4 shows another part-sectional view of the hammer mechanism from FIG. 1, which shows an impact-generation deactivation unit of the hammer mechanism.

FIG. 4 shows a section that runs perpendicularly to the section of FIG. 2 and parallel to strike direction 98*a*, in which operating element 28*a* is disposed in two different positions in the sections of FIGS. 2 and 4. Operating element 28*a* is developed in the form of a ring. It coaxially encloses the axis of rotation of clamping chuck drive shaft 32*a*. Operating element 28*a* is rotatable and connected to sliding block guide 122*a* in torsionally fixed manner. Sliding block guide 122*a* is likewise developed in the form of a ring. Sliding block guide 122*a* is provided with a bevel 124*a*. Bevel 124*a* connects two surfaces 126*a*, 128*a* of sliding block guide 122*a*. Surfaces 126*a*, 128*a* are aligned perpendicularly to strike direction 98*a*. Surfaces 126*a*, 128*a* are disposed in different planes in strike direction 98*a*.

In an impact drilling mode, blocking element 120*a* is situated inside a recess 130*a*, which is delimited, for one, by bevel 124*a* and one of surfaces 126*a*. This surface 126*a* is situated closer to drive motor 14*a* than the other surface 128*a*. Housing 12*a* has a housing element 132*a*, which mounts the blocking element in torsionally fixed manner and allows it to move in strike direction 98*a*. As a result, blocking element 120*a*, together with clamping chuck 24*a*, is able to be pressed in a direction counter to the strike direction 98*a* at the start of an impact-drilling operation. In an impact-drilling operation, blocking element 120*a* does not exert any blocking force on clamping chuck 24*a*. When operating element 28*a* of impact-generation deactivation unit 118*a* is rotated, blocking element 120*a* is moved through bevel 124*a* in strike direction 98*a*. In the drilling or screwing mode, blocking element 120*a* is kept in this frontal position. Blocking element 120*a* thereby prevents axial shifting of clamping chuck drive shaft 32*a* in the drilling or screwing mode.

FIGS. 5 through 11 show additional exemplary embodiments of the present invention. The following descriptions and the figures are essentially limited to the differences between the exemplary embodiments. Regarding components designated in the same way, particularly regarding components provided with identical reference numerals, it is basically also possible to refer to the drawings and/or the description of the other exemplary embodiments, especially of FIGS. 1 through 4. In order to distinguish the exemplary embodiments, the letter a has been added after the reference numerals of the exemplary embodiment in FIGS. 1 through 4. In the exemplary embodiments of FIGS. 5 through 11, the letter a has been replaced by the letters b through e.

Figure 5:
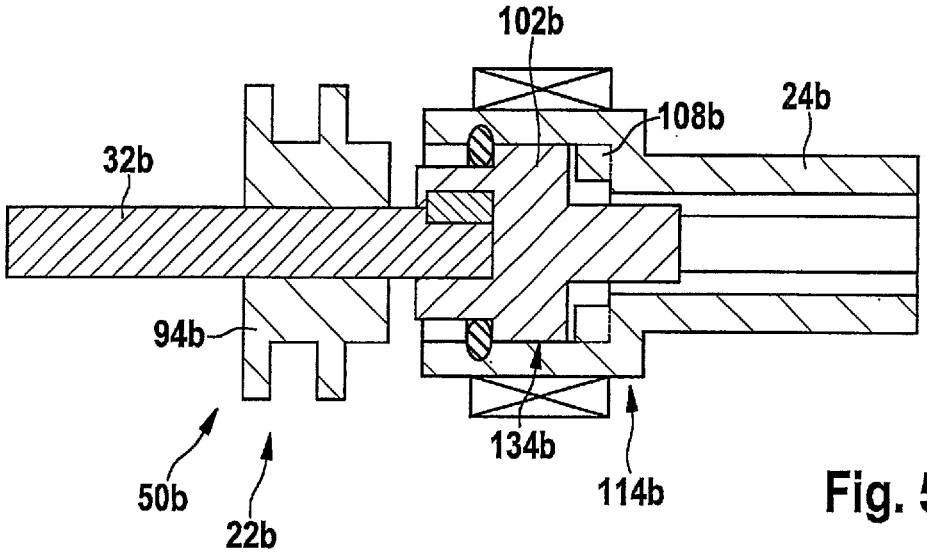
FIG. 5 shows a first alternative exemplary embodiment of a snap die of the hammer mechanism from FIG. 1 in a schematic representation.

FIG. 5 shows a portion of a hammer mechanism 22*b*. A hammer means 94*b* of an impact-generation unit 50*b* of hammer mechanism 22*b* is mounted in movable manner on a clamping chuck drive shaft 32*b* of hammer mechanism 22*b*. Clamping chuck drive shaft 32*b* is joined to a snap die 102*b* of hammer mechanism 22*b* in torsionally fixed and axially displaceable manner. Snap die 102*b* is provided with a coupling means 108*b* which forms a torsionally fixed connection to a clamping chuck 24*b* of hammer mechanism 22*b* in at least one operating state. Coupling means 108*b* is situated on a side that is facing a tapered region 114*b* of clamping chuck 24*b*. Coupling means 108*b* is developed as teething. A sealing region 134*b* of the snap die is resting against clamping chuck 24*b* without gear teeth and advantageously prevents dust from entering impact generation unit 50*b*.

Figure 6:
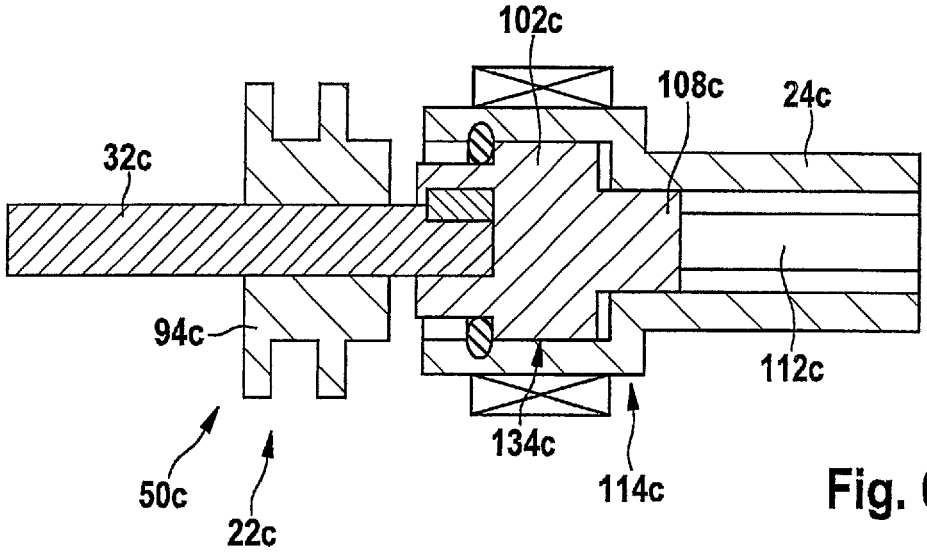
FIG. 6 shows a second alternative exemplary embodiment of a snap die of the hammer mechanism from FIG. 1 in a schematic representation.
Figure 7:
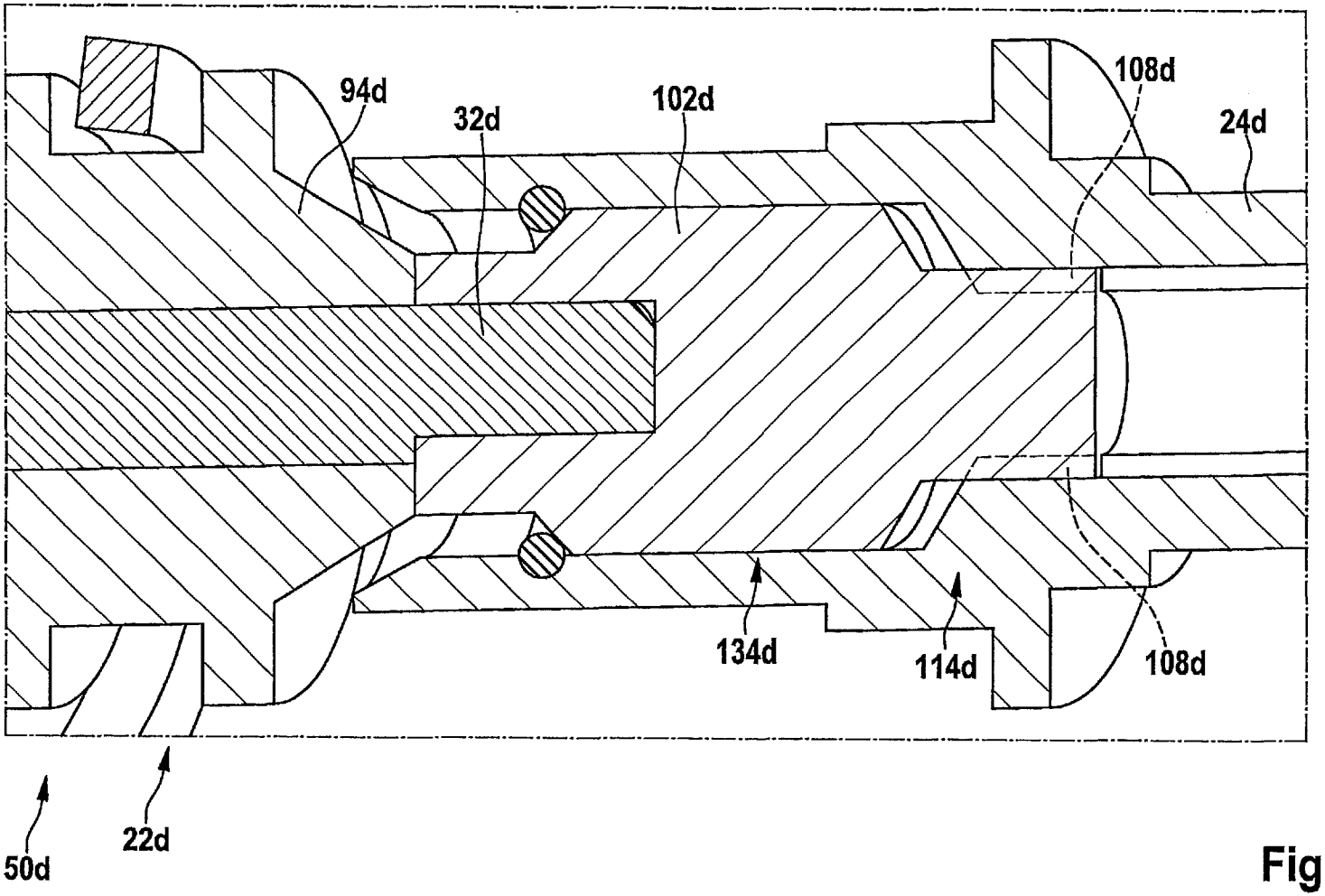
FIG. 7 shows a third alternative exemplary embodiment of a snap die of the hammer mechanism from FIG. 1 in a sectional view.
Figure 8:
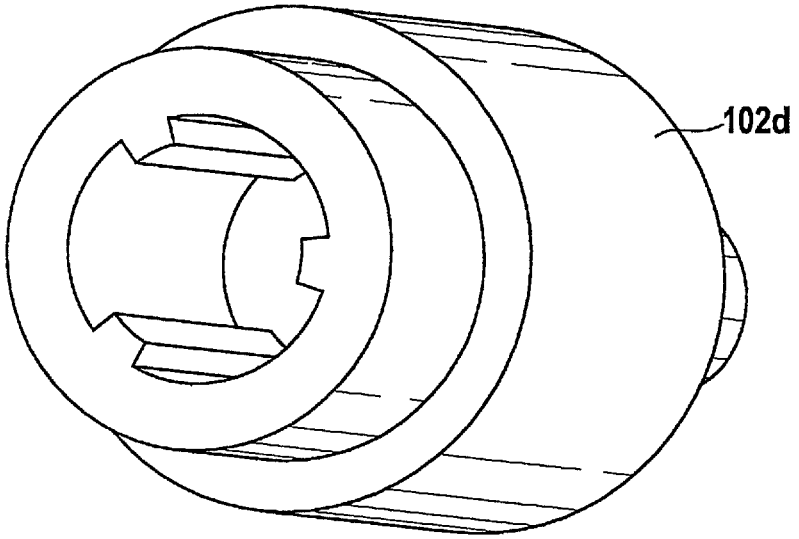
FIG. 8 shows the snap die from FIG. 7 in a first perspective view.
Figure 9:
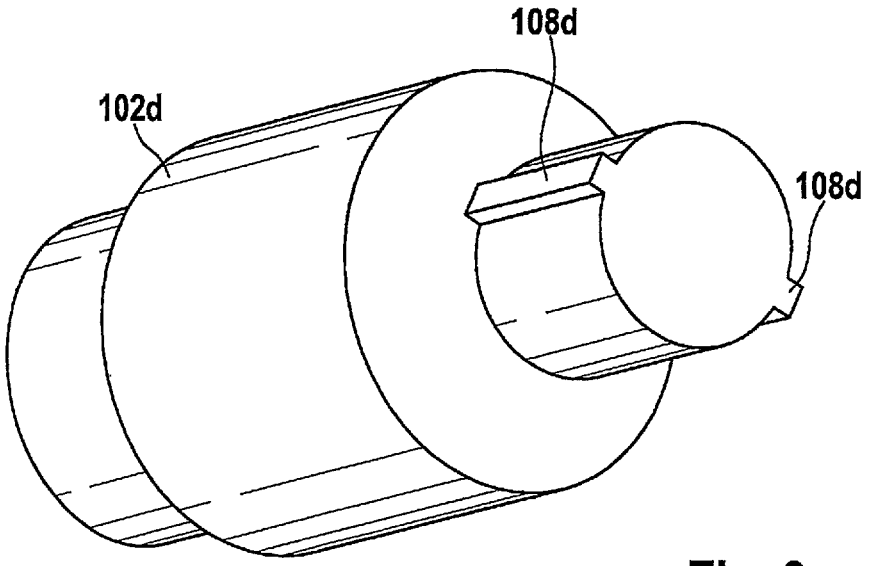
FIG. 9 shows the snap die from FIG. 7 in a second perspective view.
Figure 10:
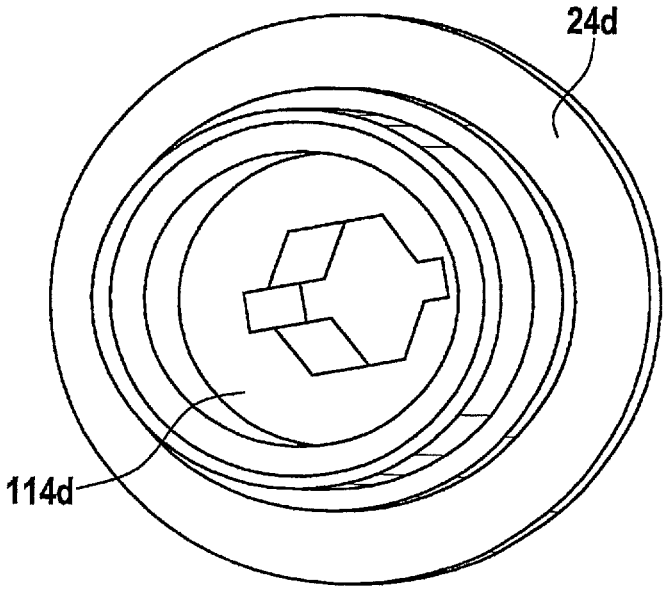
FIG. 10 shows a portion of a clamping chuck of the hammer mechanism of FIG. 7 in a perspective view.

FIG. 6, like FIG. 5, schematically illustrates a portion of hammer mechanism 22*c*. A hammer means 94*b* of an impact-generation unit 50*c* of hammer mechanism 22*c* is mounted in movable manner on a clamping chuck drive shaft 32*c* of hammer mechanism 22*c*. Clamping chuck drive shaft 32*c* is joined to a snap die 102*b* of hammer mechanism 22*c* in torsionally fixed and axially displaceable manner. Snap die 102*c* includes a coupling means 108*c* which forms a torsionally fixed connection to a clamping chuck 24*c* of hammer mechanism 22*c* in at least one operating state. Clamping chuck 24*c* has an inserted-tool coupling region 112*c*, in which coupling means 108*c* of snap die 102*c* at least partially engages. One inserted-tool coupling region 112*c* is provided to exert forces on an inserted tool in the peripheral direction during operation. In an operative state, coupling means 108*c* is at least partially disposed inside a tapered region 114*c* of clamping chuck 24*c*. Coupling means 108*c* is developed in the form of an external hexagon. The dimensions of the external hexagon correspond to the usual dimensions of a bit for a screwing operation. A sealing region 134*c* of the snap die 102*c* rests against clamping chuck 24*c* without gear teeth and advantageously prevents dust from entering impact-generation unit 50*b* in a cost-effective manner. Especially fat loss is able to be minimized.

FIGS. 7 through 10 also show a portion of a hammer mechanism 22*d* as a section and a perspective view. A hammer means 94*d* of an impact-generation unit 50*d* of hammer mechanism 22*d* is mounted in movable manner on a clamping chuck drive shaft 32*d* of hammer mechanism 22*d*. Clamping chuck drive shaft 32*d* is joined to a snap die 102*d* of hammer mechanism 22*d* in torsionally fixed and axially displaceable manner. Snap die 102*d* includes a coupling means 108*d*, which in at least one operating state forms a torsionally fixed connection to a clamping chuck 24*d* of hammer mechanism 22*d*. In an operative state, coupling means 108*d* is at least partially disposed inside a tapered region 114*d* of clamping chuck 24*d*. Coupling means 108*d* is developed as teething and has two coupling ribs lying opposite each other in relation to the axis of rotation. Coupling means 108*d* has the same form and the same dimensions as a coupling means for the coupling with an insertion tool. The form and the dimensions correspond to those of the SDS Quick standard. A sealing region 134*d* of snap die 102*d* rests against clamping chuck 24*d* without gear teeth.

Figure 11:
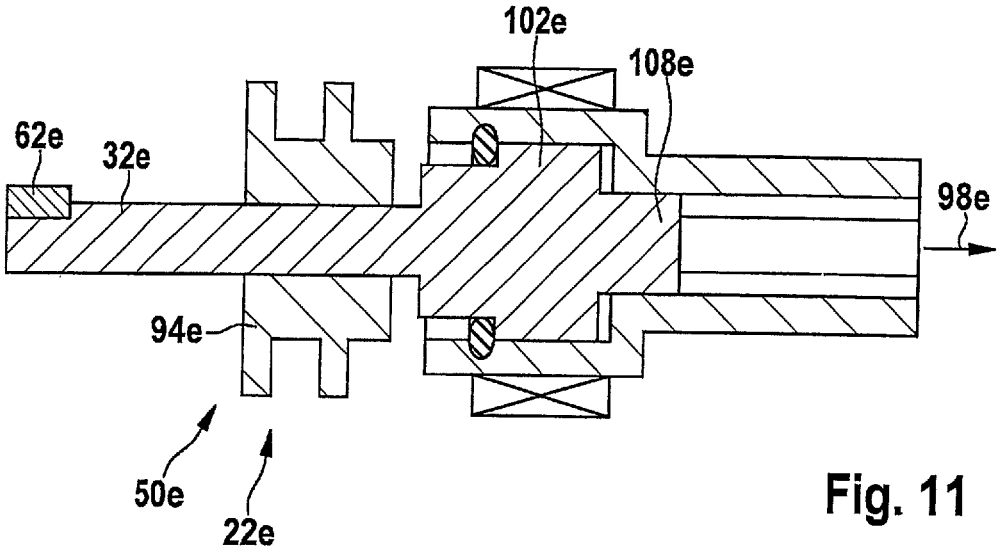
FIG. 11 shows a fourth alternative exemplary embodiment of a snap die of the hammer mechanism from FIG. 1 in a schematic representation.

FIG. 11, like FIG. 5, schematically illustrates a portion of hammer mechanism 22*e*. A hammer means 94*e* of an impact-generation unit 50*e* of hammer mechanism 22*e* is mounted in movable manner on a clamping chuck drive shaft 32*e* of hammer mechanism 22*e*. Clamping chuck drive shaft 32*e* is joined to a snap die 102*e* of hammer mechanism 22*e* in torsionally and axially fixed manner. Clamping chuck drive shaft 32*e* and snap die 102*e* are developed in one piece. During a strike, hammer means 94*e* moves both clamping chuck drive shaft 32*e* and snap die 102*e* in strike direction 98*e*. With the aid of a coupling means 62*e*, clamping chuck drive shaft 32*e* is connected in axially displaceable and torsionally fixed manner to a planetary-gear stage described in the exemplary embodiment of FIGS. 1 through 4.

What is claimed is:

1. A hammer mechanism, comprising:

at least one impact-generation unit having a strike element;

a clamping chuck drive shaft which mounts the strike element in a movable manner in a strike direction in at least one operating state; and a coupling element which is connected to the clamping chuck drive shaft in a torsionally fixed manner and drives the impact-generation unit, wherein the coupling element and the clamping chuck drive shaft are configured as a single piece.

2. The hammer mechanism as recited in claim 1, wherein the clamping chuck drive shaft at least partially penetrates the strike element.

3. The hammer mechanism as recited in claim 1, further comprising:

at least one bearing which is provided to mount the clamping chuck drive shaft in an axially displaceable manner.

4. The hammer mechanism as recited in claim 1, further comprising:

a planetary gearing which drives the clamping chuck drive shaft in at least one operating state.

5. The hammer mechanism as recited in claim 4, wherein the clamping chuck drive shaft includes an additional coupling element which is provided to produce an axially displaceable, torsionally fixed connection to the planetary gearing.

6. The hammer mechanism as recited in claim 1, further comprising:

a torque restriction device which restricts a torque transmitted via the clamping chuck drive shaft to a predetermined maximum permissible torque.

7. The hammer mechanism as recited in claim 1, further comprising:

a clamping chuck and a snap die having a coupling arrangement provided to transmit a rotary motion to the clamping chuck.

8. The hammer mechanism as recited in claim 7, further comprising:

an impact-generation deactivation unit having a blocking element which, at least in a drilling operation, acts on the snap die parallel to a force of the clamping chuck drive shaft.

9. The hammer mechanism as recited in claim 8, wherein the hammer mechanism is a part of a handheld tool.

10. The hammer mechanism as recited in claim 1, wherein the impact-generation unit has a spur gear transmission stage which translates a rotational speed of the clamping chuck drive shaft into a higher rotational speed for impact generation.

11. A hammer mechanism, comprising:

at least one impact-generation unit having a strike element;

a clamping chuck drive shaft which mounts the strike element in a movable manner in a strike direction in at least one operating state; and a coupling element which is connected to the clamping chuck drive shaft in a torsionally fixed manner and drives the impact-generation unit, wherein the coupling element is configured to dip into a coupling arrangement of the impact-generation unit when at least one strike mode is activated.

12. The hammer mechanism as recited in claim 11, wherein the clamping chuck drive shaft at least partially penetrates the strike element.

13. The hammer mechanism as recited in claim 11, further comprising:

at least one bearing which is provided to mount the clamping chuck drive shaft in an axially displaceable manner.

14. The hammer mechanism as recited in claim 11, further comprising:

a planetary gearing which drives the clamping chuck drive shaft in at least one operating state.

15. The hammer mechanism as recited in claim 14, wherein the clamping chuck drive shaft includes an additional coupling element which is provided to produce an axially displaceable, torsionally fixed connection to the planetary gearing.

16. The hammer mechanism as recited in claim 11, further comprising:

a torque restriction device which restricts a torque transmitted via the clamping chuck drive shaft to a predetermined maximum permissible torque.

17. The hammer mechanism as recited in claim 11, further comprising:

a clamping chuck and a snap die having a coupling arrangement provided to transmit a rotary motion to the clamping chuck.

18. The hammer mechanism as recited in claim 17, further comprising:

an impact-generation deactivation unit having a blocking element which, at least in a drilling operation, acts on the snap die parallel to a force of the clamping chuck drive shaft.

19. The hammer mechanism as recited in claim 18, wherein the hammer mechanism is a part of a handheld tool.

20. The hammer mechanism as recited in claim 11, wherein the impact-generation unit has a spur gear transmission stage which translates a rotational speed of the clamping chuck drive shaft into a higher rotational speed for impact generation.

* * * * *